US007316343B2

(12) United States Patent
Leifeld et al.

(10) Patent No.: US 7,316,343 B2
(45) Date of Patent: Jan. 8, 2008

(54) FOLDING BOX WITH FOLD-DOWN ATTACHMENT FLAP

(75) Inventors: Sabine Leifeld, Berlin (DE); Michael Fuchs, Dischingen (DE)

(73) Assignees: Schering AG, Berlin (DE); Carl Edelmann GmbH & Co. KG, Heidenheim (DE)

( * ) Notice: Subject to any disclaimer, the term of this patent is extended or adjusted under 35 U.S.C. 154(b) by 0 days.

(21) Appl. No.: 10/620,798

(22) Filed: Jul. 17, 2003

(65) Prior Publication Data

US 2004/0099564 A1 May 27, 2004

Related U.S. Application Data

(60) Provisional application No. 60/396,100, filed on Jul. 17, 2002.

(30) Foreign Application Priority Data

Aug. 16, 2002 (DE) ..... 102 38 512

(51) Int. Cl.
*B65D 5/52* (2006.01)
*B65D 25/00* (2006.01)

(52) U.S. Cl. ..... 229/117.18; 206/736; 206/767; 206/806

(58) Field of Classification Search ..... 229/117.12, 229/117.18, 117.22, 940; 206/806, 45.28, 206/45.29, 736, 767, 768
See application file for complete search history.

(56) References Cited

U.S. PATENT DOCUMENTS 2,004,358 A * 6/1935 Wolf ..... 229/117.22
2,784,898 A * 3/1957 George ..... 229/940
3,089,633 A 5/1963 Renshaw
3,181,772 A * 5/1965 Collins et al. ..... 229/117.22
3,946,936 A * 3/1976 Brown ..... 206/806
4,121,755 A * 10/1978 Meseke et al. ..... 229/117
4,201,292 A * 5/1980 Davidson et al. ..... 229/117.18
4,279,376 A * 7/1981 Roccaforte ..... 229/117.22
4,291,807 A * 9/1981 Giordano et al. ..... 206/806

(Continued)

OTHER PUBLICATIONS

Patent Abstracts of Japan vol. 2002, No. 03, Apr. 3, 2002 & JP 2001, 315762 A (Tooin KK), Nov. 13, 2001.

(Continued)

*Primary Examiner*—Gary E Elkins
(74) *Attorney, Agent, or Firm*—Millen, White, Zelano & Branigan, P.C.

(57) ABSTRACT

A sealable folding box in the shape of a parallelepiped or cube with attached bottom and cover flaps and an attachment flap—is provided with an attachment recess—is that is arranged on an edge of the folding box body that extends between these flaps. To this end, the folding-box body—seen in the lengthwise direction of the matrix—has a sealing flap on one end and a combination section on the other end. The combination section consists of an inside area and at least one outside area, whereby the inside area is an attachment flap—provided with an attachment recess—while the outside area is used to attach the combination section to the side wall with which it is in contact. With the invention, a folding box is provided that can be handled simply and reliably in production, storage and filling, that encloses the contents largely dust-tight and that can be marketed stacked or suspended.

7 Claims, 4 Drawing Sheets

Figure 1:
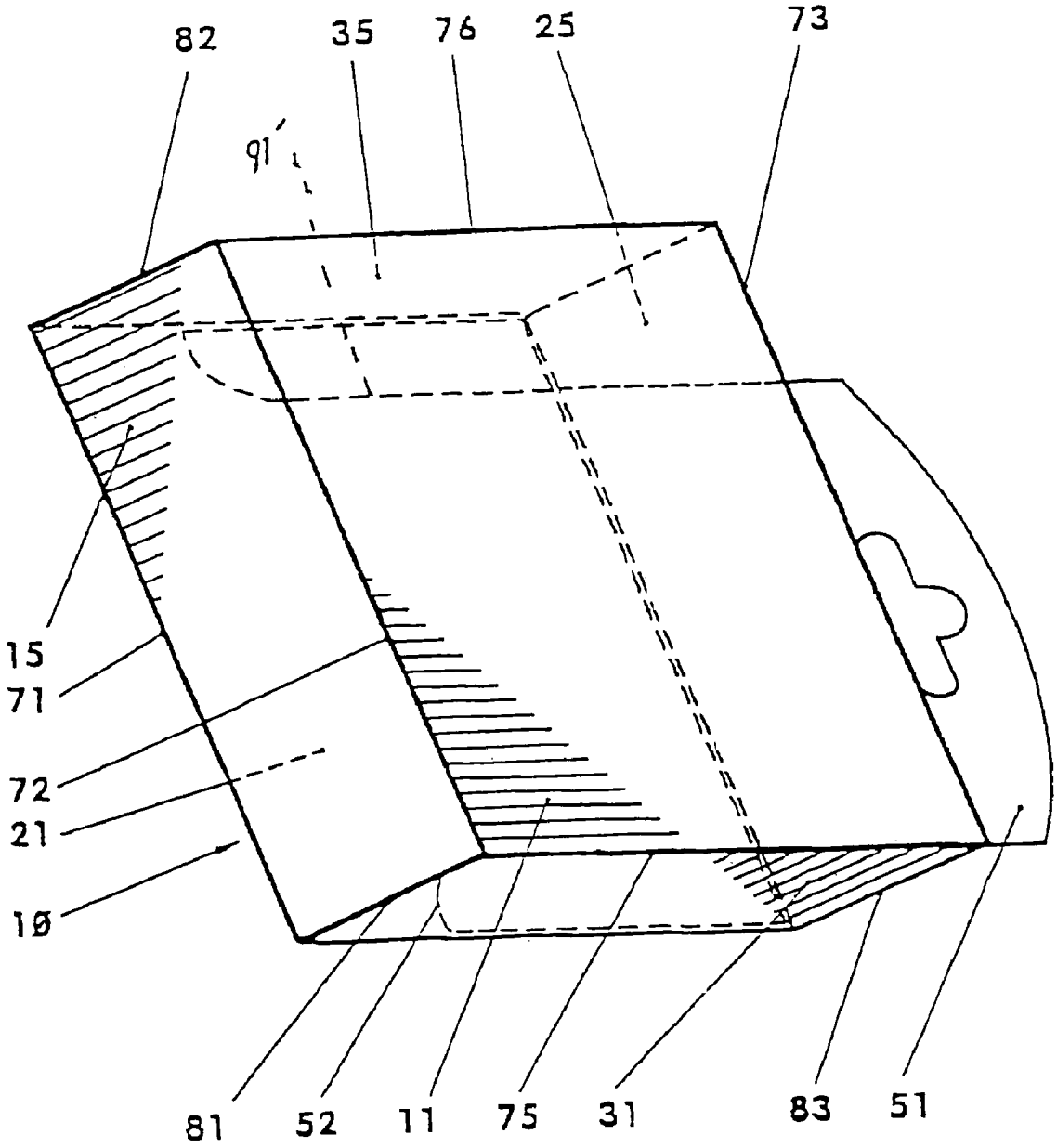

U.S. PATENT DOCUMENTS 4,331,240 A * 5/1982 Vanasse ..... 206/806
4,360,106 A * 11/1982 Irvine et al. ..... 206/806
4,634,007 A * 1/1987 Rusnock ..... 229/940
4,949,845 A * 8/1990 Dixon ..... 206/806
5,117,973 A * 6/1992 Lo Duca ..... 206/45.29
5,222,657 A * 6/1993 Holland, Jr. ..... 206/459.5
5,263,586 A * 11/1993 Keable ..... 206/469
6,053,325 A * 4/2000 Yonker et al. ..... 206/806
6,279,820 B1 * 8/2001 Collinet ..... 229/117.18
6,402,018 B2 * 6/2002 Schultz ..... 206/806

OTHER PUBLICATIONS

Patent Abstracts of Japan vol. 1996, No. 09, Sep. 30, 1996 & JP 08133271 A (Niwa Insatsu KK).

* cited by examiner

FOLDING BOX WITH FOLD-DOWN ATTACHMENT FLAP

RELATED APPLICATION

This application claims priority to U.S. provisional application Ser No. 60/396,100, filed Jul. 17, 2002.

The invention relates to a sealable folding box in the shape of a parallelepiped or cube with attached bottom and cover flaps and an attachment flap—provided with an attachment recess—that is arranged on an edge of the folding box body that extends between these flaps.

Such a folding box is known. The firm Berlex' Laboratories, Wayne, N.J. 07470 produces the imprint "YASMIN® 28 tablets, Patient Starter Pack" in a parallelepiped-shaped design. On one of the two large-area side walls of this folding box, an attachment flap is arranged as a side-wall extension. The attachment flaps and the side walls are of the same length. An adhesive flap that is almost identical to the attachment flap is arranged on the small side wall that orthogonally abuts this side wall in the area of the attachment flap. The adhesive flap is folded outward in production to be able to be glued over the entire surface to the attachment flap. This has the result that when the folding box is assembled, the attachment flap rigidly projects over the latter. As a result, the folding box is bulky when being handled at the filling plant and later in commercial use. In addition, leaks are produced along the folding zone located there by the outside folding of the adhesive flap. Finally, a perforation or a number of slotted punch-outs are required in the folding zone for the outside folding as a substitute for grooving on the back side that would otherwise be necessary. The perforation or the punch-outs and the grooves that are necessary for the folds are all incorporated from the printing side into the matrix.

This invention therefore is based on the formulation of the problem of developing a folding box that allows simple and reliable handling in production, storage and filling, that encloses the contents largely dust-tight and that can be marketed stacked or suspended.

The problem is solved with the features of the main claim. To this end, in addition to four side walls, the folding-box body—in the lengthwise direction of the matrix—has a sealing flap on one end and a combination section on the other end, whereby after the folding box is formed, the sealing flap comes to rest inside on the side wall, which when the matrix of the folding box is extended, is the furthest from it, while in certain areas, the combination section is attached on the outside flat against the side wall, which, when the matrix of the folding box is extended, is the furthest from it. The combination section consists of an inside area and two outside areas, whereby the inside area is an attachment flap—provided with an attachment recess—while the outside areas are used to attach the combination section to the side wall with which it is in contact. The outside area is connected to the inside area via a separating structure.

With the subject according to the invention, a folding box with a fold-down attachment flap that is easy to produce is created, in which the attachment flap is part of a combination section. This combination section securely closes the folding box, e.g., by adhesion with an adjacent box side wall. When the attachment flap is pulled off and folded down, the contents of the folding box in addition remain inaccessible and dust-free.

Since the attachment flap is folded down only once—if at all—in commercial use, the folding box can be handled easily during filling.

Figure 2:
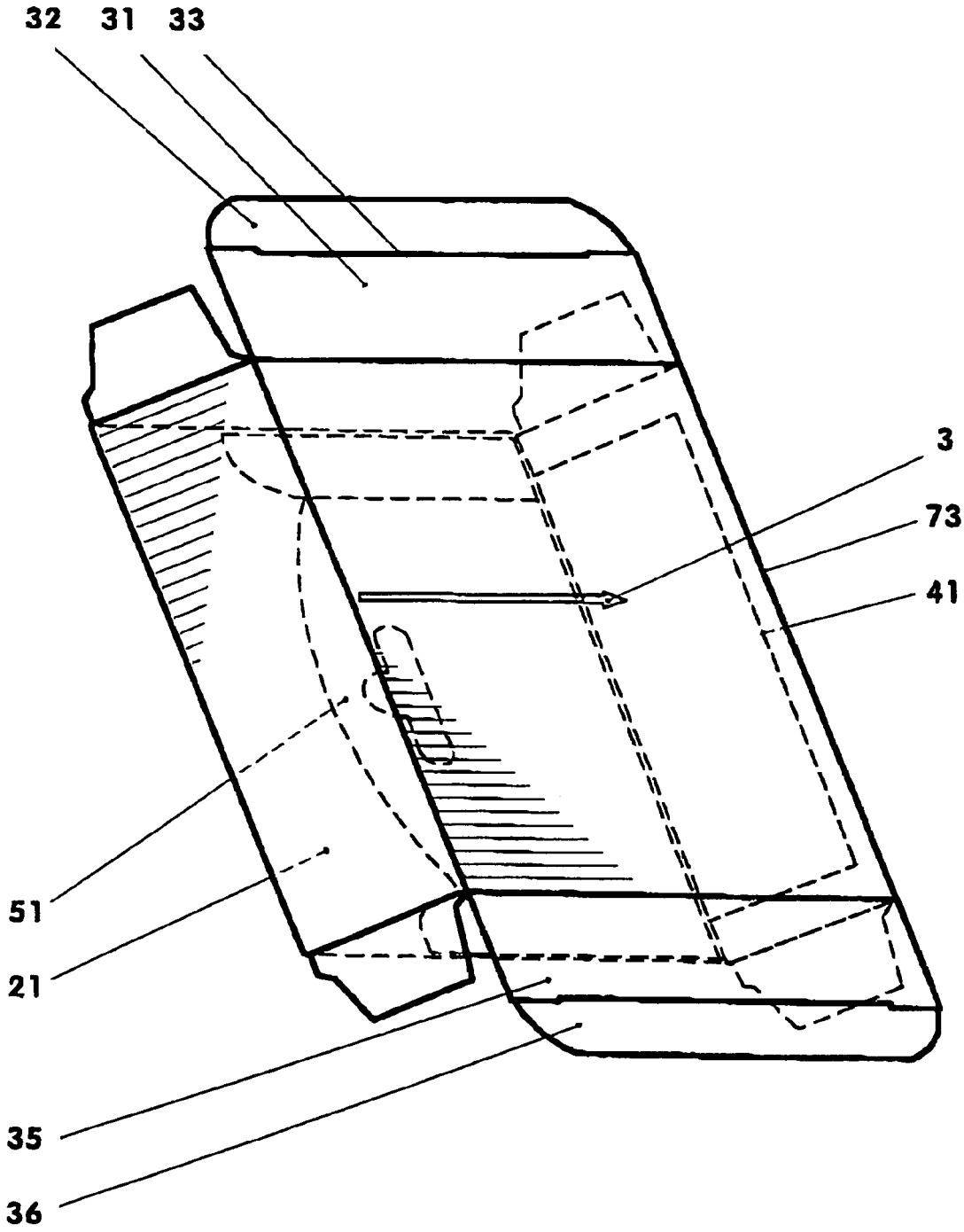
Figure 3:
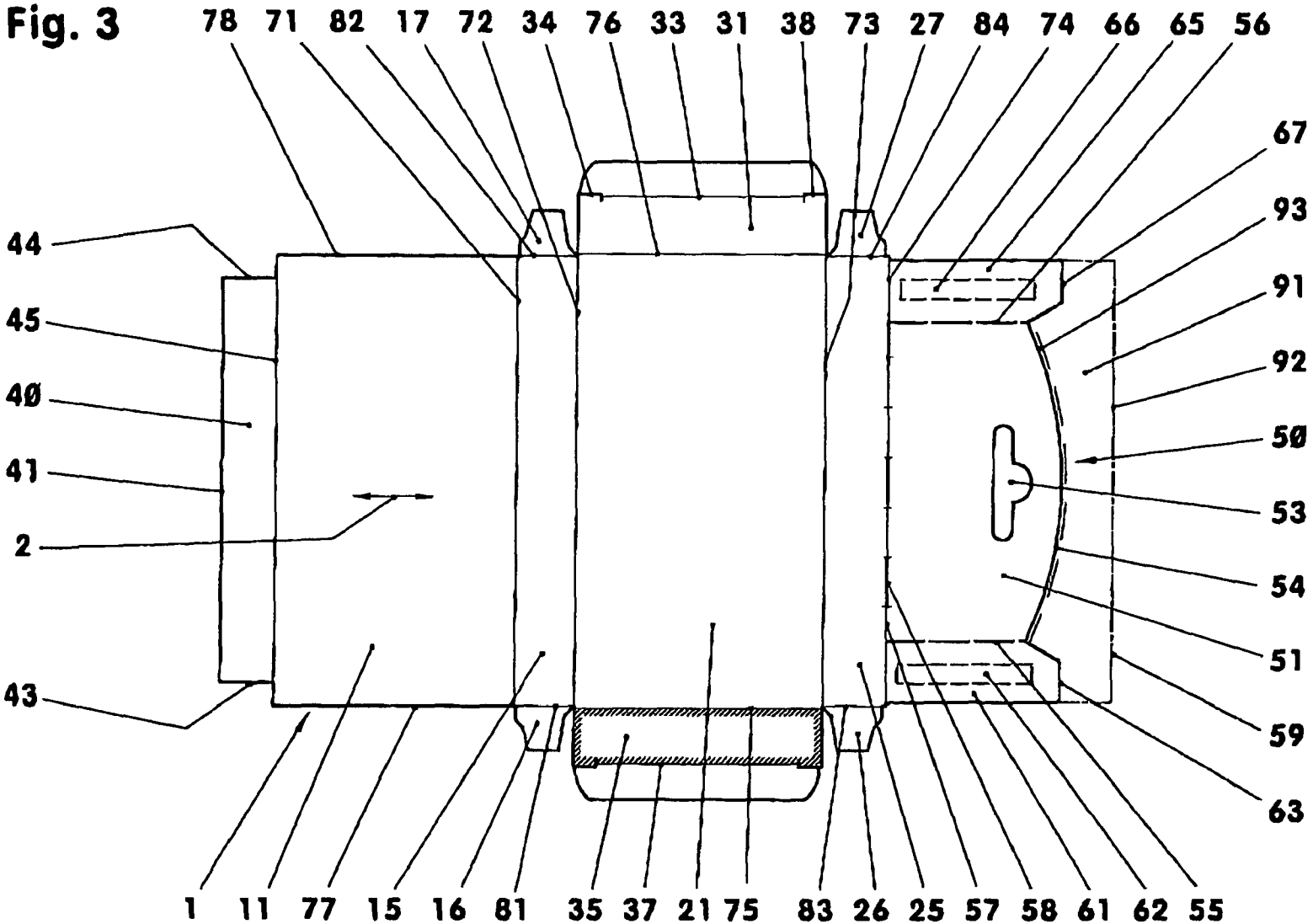
Figure 4:
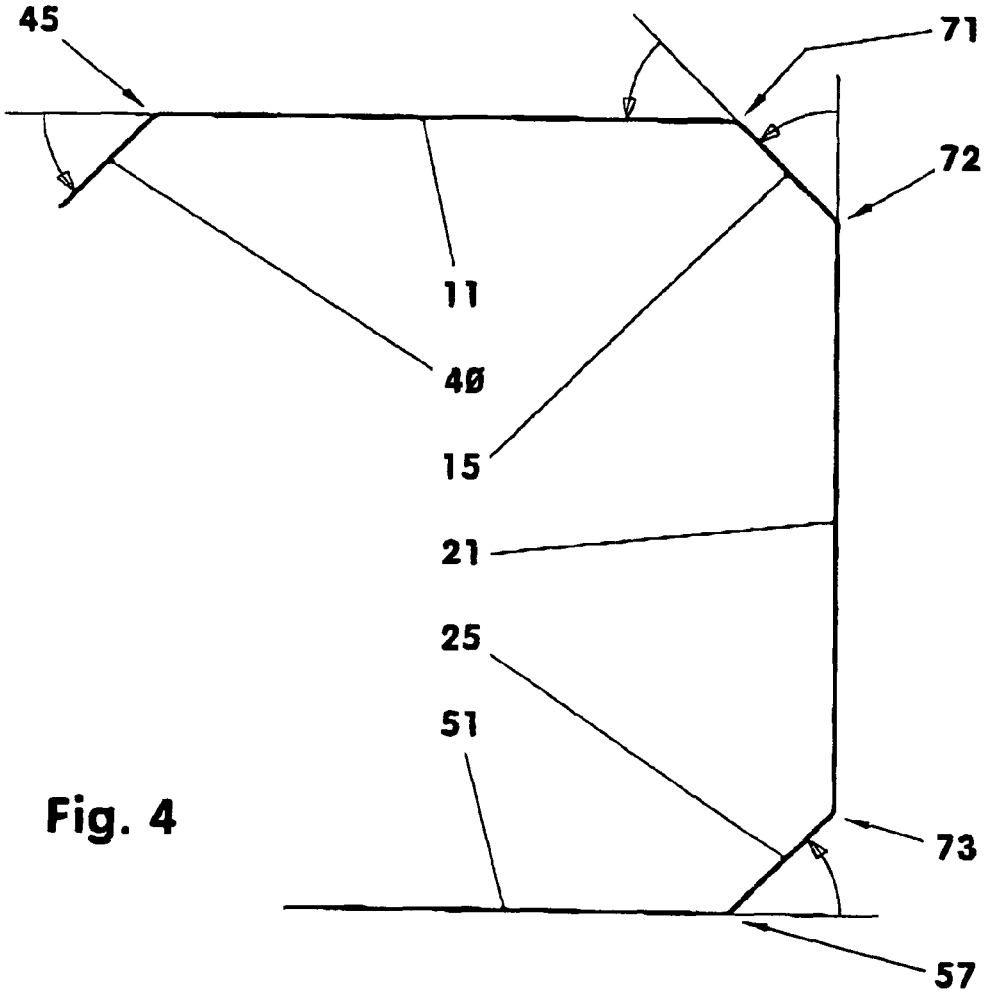
Figure 5:
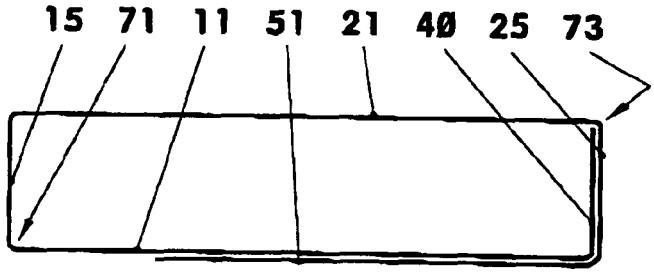
Figure 6:
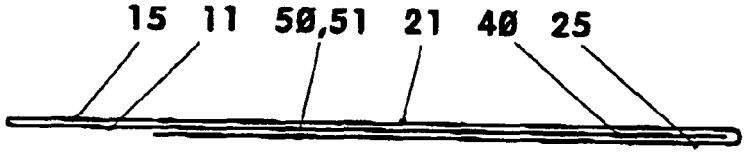

Other details of the invention emerge from the subclaims that are not cited or that are only partially cited and the subsequent description of an embodiment that is depicted diagrammatically:

FIG. 1: Folding box, closed with an attachment flap that is not integral with the box;

FIG. 2: Folding box, assembled and open with an attachment flap attached;

FIG. 3: Matrix of the folding box, extended;

FIG. 4: Folding direction of the individual matrix sections, viewed from the front;

FIG. 5: Folding box blank formed in a square tube, viewed from the front;

FIG. 6: Folding box blank folded together for stacking, viewed from the front.

FIG. 1 shows a closed folding box (10) in the shape of a parallelepiped with an attachment flap (51) that is not integral with the box. Folding box (10) has four side walls in the form of front panel (11), bottom panel (15), back panel (21) and top panel (25), of which two each are arranged parallel to one another. Side walls (11, 15, 21, 25) form a type of square tube, cf. FIG. 5, which is sealed on both sides by flaps that form a first side panel (31) and a second side panel (33) that are attached to back wall (21).

FIG. 3 depicts folding box (10) laid out flat as a matrix folding box (10) consisting of a single, one-part cardboard blank, whose fibers are preferably oriented in lengthwise direction (2) of matrix (1). The cardboard has, for example, a specific weight of about 250 g/m$^2$. It is printed at least in certain areas and coated with a transparent paint. Side walls (11, 15, 21, 25) are central components of folding box (10) that are arranged behind one another from the left to the right. Rectangular side walls (11, 15, 21, 25) that are adjacent to one another are delimited from one another by corresponding parallel grooves (71-73). The area of grooves (71-73) or the material that directly surrounds the latter forms the lengthwise edges of the box in finished folding box (10). All grooves that are incorporated in the cardboard of matrix (1) are located on the smooth top side of the cardboard.

On large side wall (21), bottom flap (31) and cover flap (35) are arranged in the area of the short side edges or grooves (75, 76). Both flaps (31, 35) end in inserts (32, 36). Relative to flaps (31, 35), inserts (32, 36) are delimited in turn in each case by a groove (33, 37). On the two-sided ends of grooves (33, 37) are located angular punch-outs (34, 38) that prevent flaps (or side panel 31, 35) from penetrating inside folding box (10) when folding box (10) is closed by attaching to short side edges (77, 78).

According to FIG. 3, cover flap side panel (35) has a field with a cross-hatched border. In this area, the cardboard is unpainted to be able to print variable data on it—if necessary, e.g., after the filling.

On small side walls (bottom panel 15) and (top panel 25) that are placed on both sides is addition to large side wall (back panel 21), in each case, e.g., seven-edgeed side flaps (inthe forms os tabs 16, 17, 26, 27) close upward and downward according to FIG. 3. Also here, e.g., grooves (81-84) form a limit between side flaps (in the form of tabs 16, 17, 26, 27) and side walls (or the form of bottom and top panels 15, 25). With the aid of the latter, the small side edges of finished, closed folding box (10) are formed.

In the embodiment according to FIG. 3, a so-called sealing flap (40) is arranged on the left outside edge of large side wall (in the form of front panels 11), which is connected by a groove (45). Sealing flap (40), which, after folding box (10) is formed, comes to rest inside on small side wall (in the form of top panel 25), is somewhat smaller in area in lengthwise direction (2) and crosswise direction than side wall (25) with which it is in contact. In lengthwise direction, e.g., it is about 15% shorter, while in crosswise direction, for example, it is about 10% narrower. Sealing flap (40) has two side edges (43, 44) that are, for example, shifted to the rear in parallel relative to short side edges (77, 78) of the front panel 11. The short side edges (77, 78) are free edges in that they are not attached to any additional box structure.

On the other end of matrix (1) is found, for example, three-part combination section (50), which is connected via a groove (57) or snap-off structure to integrated slotted punch-outs (58) in certain sections. Here, combination section (50) comprises two outside sections (61, 65) and one inside section (51). These sections (51, 61, 65) are delimited from one another by separating structures (55, 56). Separating structures (55, 56) run between groove (57) and free outside edge (54) of middle or inside section (51), for example parallel to lengthwise direction (2) of matrix (1). They are optionally oriented obliquely such that their imaginary extension lines, according to FIG. 3, cut to the right outside of outside edge (54).

Slotted punch-outs (58) are located only between separating structures (55, 56). The width of inside section (51) is—measured crosswise to lengthwise direction (2)-about 73% of the total width of combination section (50) in the area of snap-off structure (57). The width of this section (51) should not exceed 75% of the total width of combination section (50).

The grooves 45, 71, 72, 75, 76, 73 and 57 each form seams which join the panels 11, 15, 21 and 25, side flaps 31 and 35, sealing flap 40 and attachment flap 51 to form the unitary matrix 1.

Outside edge (54) is designed curved outward only by way of example. It can have almost any shape. This also applies for adjacent outside edges (63) and (67) of outside sections (61, 65), which are curved at an angle according to FIG. 3 or in an arc according to FIGS. 1 and 2. The curves of outside edges (63, 67) encompass, e.g., an angle of 120° C. Two recesses, whose tips in each case end before one of separating structures (55, 56), are created by the arch of outside edge (54) and the curves of edges (63, 67). According to FIG. 3, the recesses have, for example, an opening angle of 90 to 100°. Separating structures (55, 56) here are perforations, thus hole or slotted punch-outs, which make possible or facilitate a separation of inside section (51) from two outside sections (61, 65).

Two outside sections (61) and (65) can alternately be connect to one another via a connecting bridge (91). This connecting bridge (91) has an outside edge (92) that is depicted in dots and dashes in FIG. 3 and a perforation (93) as a boundary to attachment flap (51). Connecting bridge (91) is optionally also bonded to side (21) as is seen dotted lines 91', FIG. 1.

Outside edge (92) can reach up to long side chain (71).

The length of combination section (50)—viewed in lengthwise direction (2) of extended matrix (1)—can take up any length relative to closest side wall (25) or relative to next side wall (21) but one.

Punched, grooved, printed and painted matrix (1) is formed, as depicted in FIG. 4, into a square tube by bending at grooves (57, 73, 72, 71, 45), cf. FIG. 5. The lateral flexures—illustrated by arrows in FIG. 4—are always produced in one direction, here, e.g., counterclockwise. The expansion phases of the individual lateral flexures are always in the painted outside surface of folding box (10). Having bends or folds that run in the same direction can make it unnecessary to have a perforation or slot or hole punch-out that runs through the cardboard.

To be able to better store and warehouse the folding boxes before they are filled, they are folded together in a compact manner by a shearing action around the grooves or side edges (71) and (73). Side walls (15) and (11) now rest on side walls (21) and (25). Three layers of cardboard thus lie almost flat over one another. For example, lower layers (50, 51) and (25), middle layers (11) and (40) and upper layers (15) and (21) form.

To fill folding box (10), matrix (1) that is bonded to the square tube is moved flat, as on FIG. 6, from a warehouse to the filling area. In flat folding box (10), side walls (21) and (25) here lie directly on the filling area. Long side chain (73) is in transport direction at the front, while side chain (72) is at the back, cf. FIG. 2.

In the filling area, flat folding box (10) is directed to the square tube. Bottom flap (31), cover flap (35) and side flaps (17, 27; 16, 26) are open in the extensions of the side walls that they carry.

In front-side filling, for example via cover flap (31), a holding slide is moved into the inside of the box via the opening of bottom flap (35). In the oppisite direction, the contents, e.g., a stack of at least one filled tablet blister, a package insert, a brochure and a weekly label, is pushed against the holding slide by means of a transport slide. After the stack is placed on the holding slide, the content are placed in the middle in the assembled folding box. As soon as the slides retract from the folding box area, the folding box is sealed by closing flap (31) and (35). Insert flaps (32) and (36) are bent during closing by more than a 90-degree angle. When folding box (10) is closed, adjoin side wall (21).

The thus finished and filled folding box (10) can be stacked in this form on shelves, in compartments or in drawers in a compact manner, such that the box is shaped like a parallelepiped—with the attachment flap that is securely attached during production.

For presentation on hanging shelves, attachment flap (51) is separated along separating structures (55, 56) and optionally (93) from areas (61, 65) that are bonded to folding box (10) and from side wall (11) on which it previously rested, depending on production, folded down by about an angle of 180 degrees. The fold-down movement is carried out by fold-down structure (58). With attachment recess (53), it is pushed open on the corresponding attachment profile of the hanging shelf.

If necessary, fold-down attachment flap (51)—e.g., housing with end users—can be folded back again on side wall (11). In this case, tear-off sites of tear-off structures (55, 56) and optionally (93) of areas (51; 61, 65) that are now adjacent again interlock. Punch-outs (58) of forward-folding structure (57) are sized such that the weakening of the cardboard is sufficient to avoid a renewed, unintentional recovery of the attachment section (51) that is attached. Attachment section (51) optionally can also be torn off by the end user without folding box (10) losing its dust seal depending on construction.

LEGEND

1 Folding box blank matrix, extended
2 Fiber direction, lengthwise direction
3 Transport direction

10 Folding box
11 Side wall, large
15 Side wall, small, middle
16, 17 Side flaps
21 Side wall, large, middle
25 Side wall, small
26, 27 Side flaps
31 Bottom flap
32 Bottom flap, insert
33 Groove between (31) and (32)
34 Punch-out, angular
35 Cover flap
36 Cover flap, insert
37 Groove between (35) and (36)
38 Punch-out, angular
40 Sealing flap
41 Lengthwise edge, free
43, 44 Side edges
45 Lengthwise edge, inside
50 Combination section
51 Inside or middle section or area, attachment flap
52 Contour, arc-shaped
53 Attachment recess, Euro hole
54 Outside edge,
55, 56 Separating structure, perforation
57 Groove
58 Hinged structure, slotted punch-out
61 Outside section
62 Adhesive surface
63 Outside edge
65 Outside section
66 Adhesive surface
67 Outside edge
71-74 Lengthwise edges; grooves
75-78 Side edges, long; grooves
81-84 Side edges, short; grooves
91 Connecting bridge for sections (61) and (65)
92 Outside edge to (91)
93 Separating structure, perforation to (91)

The invention claimed is:

1. A folding box configured from a single blank of material, the box comprising:

a front panel defined by first and second seams and by two free unattached side edges;

a sealing flap extending from the first seam and a bottom panel of a selected width attached to the second seam, the sealing flap having a width less than the bottom panel;

a back panel defined by third and fourth seams;

the third seam attaching the back panel to the bottom panel and the fourth seam being parallel to the third seam and attaching a top panel to the back panel;

opposed insert flaps extending in opposite directions with respect to the panels from fifth and sixth panel seams wherein the opposed insert panels fold to form sides of the box extending perpendicular to the front and back panels when the front and back panels are parallel in spaced relation to form the box, the insert flaps having insert tabs that extend into the box in parallel relation to the panels to hold the box closed;

the top panel being defined by the fourth seam and a seventh seam, having an inside surface for juxtaposition with the sealing flap and having a width greater than the width of the sealing flap and substantially the same as the width of the bottom panel;

an attachment flap extending from the seventh seam, the attachment flap being useful to hang the box for display and the seventh seam being readily separable to detach the attachment flap from the top panel, the attachment flap having a pair of laterally disposed, detachable outside sections joined by a detachable bridge section wherein the detachable outside areas are releasably attached to the attachment flap and seventh seam, and insert tabs extending from side edges of the top and bottom panels for insertion into the box in cooperation with the first and second insert flaps to hold the box open; wherein the box can be stored in a flatten form with the sealing flap positioned for adherence adhered to the inside surface of the top panel.

2. The folding box of claim 1 wherein the first, second, third, sixth and seventh seams joining the front panel to the sealing flap and bottom panel, the bottom panel to the back panel, the back panel to the top panel and the top panel of the attachment flap, respectively, wherein each seam has an expansion phase for individual lateral flexure on an outside surface of the box so that the panels all fold in the same arcuate direction with respect of one another to initially form.

3. The folding box of claim 1 wherein the box is made of cardboard having fibers which extend perpendicular to the first, second third, sixth and seventh seams and parallel to the fourth and fifth seams.

4. The folding box of claim 1 wherein the extent of the attachment flap and bridge from the seventh seal is no greater than the distances between the first and second seams or the third and fourth seams.

5. The folding box of claim 1 wherein the top panel has an area which is at most 15% greater than the surface area of the sealing flap.

6. The folding box of claim 1 wherein when the box is stored in a flattened form the back panel is partially covered by the attachment flap and by side sections and a bridge section which are detachably seamed to the attachment flap.

7. The folding box of claim 1 wherein the top panel has a surface area which is smaller than the top panel but not smaller than the bottom panel.

* * * * *

UNITED STATES PATENT AND TRADEMARK OFFICE

CERTIFICATE OF CORRECTION

PATENT NO. : 7,316,343 B2
APPLICATION NO. : 10/620798
DATED : January 8, 2008
INVENTOR(S) : Michael Fuchs It is certified that error appears in the above-identified patent and that said Letters Patent is hereby corrected as shown below:

Column 6, line 23, reads “in a flatten form” should read -- in a flattened form --
Column 6, line 37, reads “second third,” should read -- second, third, --

Signed and Sealed this

Seventeenth Day of June, 2008

JON W. DUDAS
*Director of the United States Patent and Trademark Office*